US009057218B2

(12) United States Patent
Kennedy et al.

(10) Patent No.: US 9,057,218 B2
(45) Date of Patent: Jun. 16, 2015

(54) BLAST DOOR

(75) Inventors: Kieran Kennedy, Leamington Spa (GB); Christopher James Bolton, Leamington Spa (GB); Chris Russon, Rugby (GB)

(73) Assignee: Ingersoll Rand Security Technologies, West Midlands (GB)

( * ) Notice: Subject to any disclaimer, the term of this patent is extended or adjusted under 35 U.S.C. 154(b) by 1149 days.

(21) Appl. No.: 12/600,102

(22) PCT Filed: May 15, 2008 (Under 37 CFR 1.47)

(86) PCT No.: PCT/GB2008/001677

§ 371 (c)(1), (2), (4) Date: Dec. 9, 2011

(87) PCT Pub. No.: WO2008/139201

PCT Pub. Date: Nov. 20, 2008

(65) Prior Publication Data

US 2012/0085223 A1 Apr. 12, 2012

(30) Foreign Application Priority Data

May 15, 2007 (GB) ..... 0709349.5

(51) Int. Cl.
*E04C 2/54* (2006.01)
*E06B 5/12* (2006.01)

(52) U.S. Cl.
CPC ..... *E06B 5/12* (2013.01); *Y10T 29/49629* (2015.01)

(58) Field of Classification Search
CPC ..... E06B 5/12; Y10T 29/49629
USPC ..... 52/204.62, 204.67
See application file for complete search history.

(56) References Cited

U.S. PATENT DOCUMENTS 3,299,596 A * 1/1967 Neal et al. ..... 52/476
4,912,807 A 4/1990 Futch et al.

(Continued)

FOREIGN PATENT DOCUMENTS

BE 896386 4/1983
DE 469544 12/1928

(Continued)

OTHER PUBLICATIONS

PCT/GB2008/001677 International Search Report.

(Continued)

*Primary Examiner* — Charles A Fox
*Assistant Examiner* — Patrick Maestri
(74) *Attorney, Agent, or Firm* — Michael Best & Friedrich LLP

(57) ABSTRACT

A blast door (12; 14) comprises a panel (12*a;* 14*a*) and a frame provided around the perimeter of the panel. The frame comprises a plurality of frame members (12*b,* 12*c,* 12*d;* 14*b,* 14*c,* 14*d*). Each frame member has a cross section that includes a cavity (36, 40) in which the panel perimeter is received. This ensures that the frame encloses a perimeter portion of the panel on either side thereof. Securing means (47) are provided within the cavity of the frame, to secure the panel therein. A method of fabricating the blast door comprises providing the panel and the frame comprising the plurality of frame members, and securing the panel within the frame using securing means located within the cavity of the frame.

19 Claims, 5 Drawing Sheets

(56) References Cited

U.S. PATENT DOCUMENTS

Figure 1:
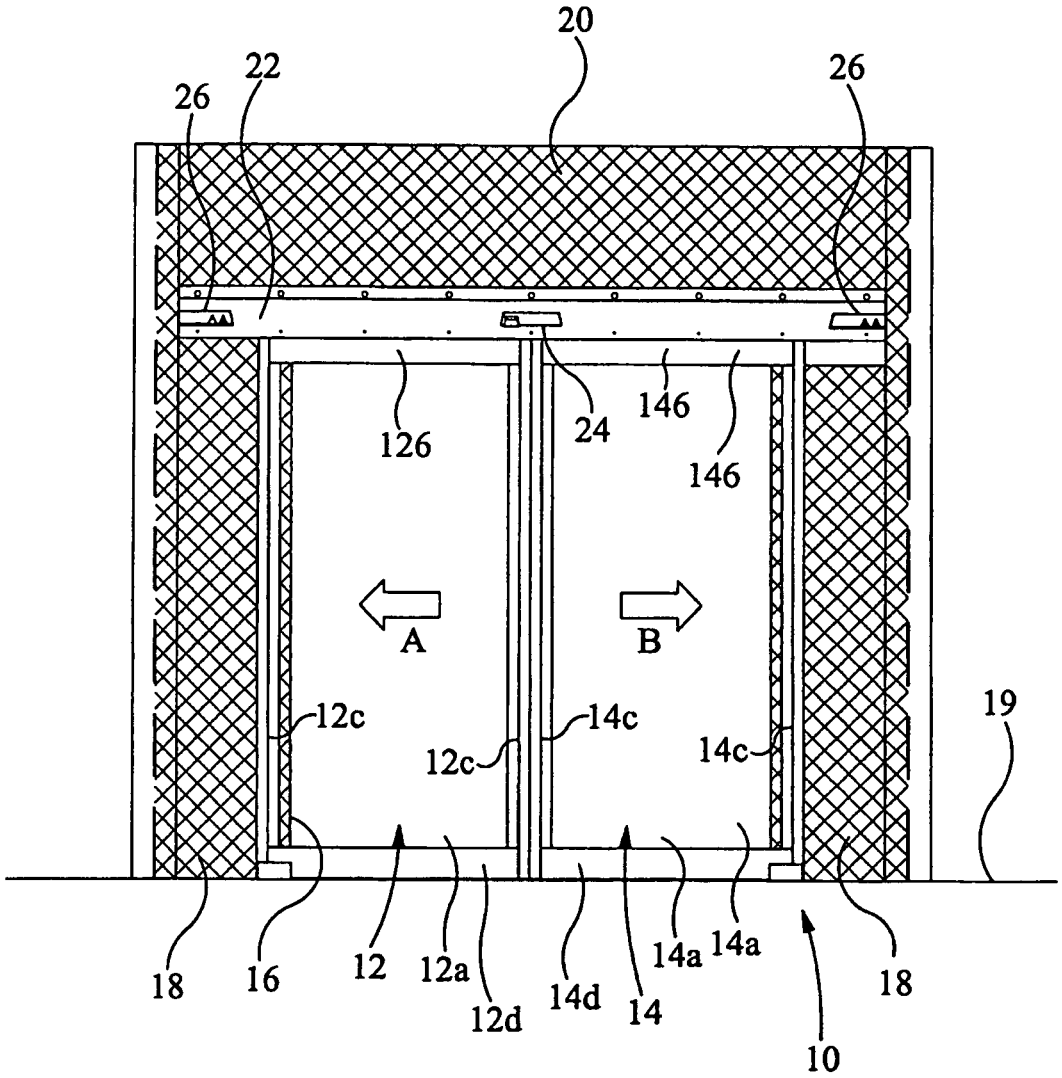

| | | | | |
|---|---|---|---|---|
| 4,956,952 | A | | 9/1990 | Bancroft |
| 5,261,203 | A | * | 11/1993 | Yoon ..... 52/455 |
| 5,761,860 | A | | 6/1998 | Koike et al. |
| 5,802,783 | A | * | 9/1998 | Bayha ..... 52/204.5 |
| 5,853,828 | A | | 12/1998 | Schimmelpenningh et al. |
| 6,065,249 | A | | 5/2000 | Gephert et al. |
| 6,360,499 | B1 | | 3/2002 | Sugiura |
| 6,581,342 | B1 | | 6/2003 | Tavivian |
| 6,737,151 | B1 | | 5/2004 | Smith |
| 6,745,526 | B1 | | 6/2004 | Autovino |
| 2003/0172596 | A1 | | 9/2003 | Talley et al. |
| 2006/0080894 | A1 | | 4/2006 | Saelzer |

FOREIGN PATENT DOCUMENTS

| | | |
|---|---|---|
| DE | 3509187 | 3/1985 |
| GB | 1431611 | 4/1976 |
| WO | 95/27119 A1 | 10/1995 |

OTHER PUBLICATIONS

European Examination Report from the European Patent Office for Application No. 08750609.3 dated Jan. 17, 2012 (3 pages).

Search Report from the United Kingdom Intellectual Property Office for Application No. GB0709349.5 dated Apr. 22, 2008 (5 pages).

* cited by examiner

18

16
14
12

94
64
94

96
98
92
96
94

58
68
62
64
64

BLAST DOOR

The present invention relates to blast doors suitable for withstanding explosions such as bomb blasts, and to methods of fabricating such blast doors. In addition, the invention relates to blast door installations.

In buildings such as airports it is necessary to provide a series of access points (e.g. doorways) accessible to the public and/or authorised personnel as required. In the case of publicly accessible parts of the building, such access points must be convenient, to allow several persons through at any one time, and easy to use. Providing automatically opening doors quickly lets persons (perhaps with large amounts of luggage, maybe on trolleys) through the doors. Typically, automatically opening sliding doors and/or glass panels may be employed. In the case of authorised personnel, the access points must be secure so that no unauthorised persons e.g. of the general public are granted admission. This may be achieved through the use of secure keypads, swipe card systems etc.

However, airports (and other buildings such as governmental institutions etc.) are perceived as being likely targets for terrorist attacks, bomb threats and the like. In the event of an explosion, any access points (for the public and restricted personnel) should also offer protection and shielding against such a blast. Certain Test Standards exist whereby access points such as airport doors must be able to withstand a bomb blast according to certain parameters and limits.

A known 'blast door' is manufactured by constructing a frame in situ in a doorway of the building to support a central glass panel. The panel is offered up to the frame and secured in place by applying beading or additional clip-on frame members.

Such known systems suffer the disadvantage that, in the event of an explosion, the force of the blast can drive the beading or clip-on frame sections from the frame allowing the glass panel or parts thereof to become detached and propelled away from the frame. This clearly presents a danger to any persons or objects in the vicinity.

It is an aim of the present invention to provide a blast door that alleviates the aforementioned problems.

According to a first aspect of the present invention there is provided a blast door comprising a substantially rectangular panel of a blast-resistant material. A frame is provided around the perimeter of the panel. The frame comprises a first pair of frame members secured along a pair of opposing perimeter edges of the panel, the ends of each of the first pair of frame members not extending beyond the panel perimeter corners. A second pair of frame members is secured along the other pair of perimeter edges of the panel, the second pair of frame members extending beyond the panel perimeter corners and overlapping the ends of the first frame members. A tie-rail extends between each of the overlapping ends of one of the second frame members and each of the overlapping ends of the other of the second frame members. Each tie rail extends along a cavity within a respective one of the first frame members.

According to a second aspect of the present invention there is provided a blast door comprising a panel. A frame is provided around the perimeter of the panel, the frame comprising a plurality of frame members wherein each frame member has a cross section that includes a cavity in which the panel perimeter is received such that the frame encloses a perimeter portion of the panel on either side thereof. Securing means secures the panel within the frame, the securing means being provided within the cavity of the frame.

It is an advantage that the frame surrounds the edges of the central panel without the need for additional clip-on/add-on frame sections or beading as, in the event of a bomb blast or other explosion, the frame acts to retain the panel therein.

In embodiments of the blast doors, the frame member cross section is c-shaped, and the panel perimeter is received within the cavity of the c-shaped cavity of the frame members. Advantageously, the panel is equally supported by the frame on both sides thereof, and the frame is of a simple construction that is easy to manufacture. Preferably the frame is of a unitary construction, for example a single component of extruded metal.

In an embodiment, the means for securing the panel within the frame is provided within the frame. Preferably, the securing means comprises bonding material provided within the cavity of the frame, between the frame and the panel. Advantageously, this decreases the likelihood of the panel becoming dislodged from the frame in the event of an explosion. The frame cavity defines an opening into the frame and sealing means may be provided between the cavity opening and the panel. Preferably, rubber seals are utilised. The bonding material and the seals act to secure the panel in position within the frame before, during and after an explosion. One or more supports may be mounted within the frame member cavity to receive the perimeter of the panel, these supports being shaped to correspond to the profile of the perimeter of the panel. This facilitates location and securing of the panel within the frame both during and after its construction.

The "cover" provided by the frame from the panel perimeter (i.e. the distance by which the frame overlaps the edge of the panel) is in the region of 35 mm. Advantageously, this cover distance aids in retaining the panel in position within the frame in the event of an explosion. By comparison, known blast door constructed with beading to retain the panel in position typically only provide a "cover" of about 7 mm. Embodiments of the present invention thus provide for superior panel retention within the frame, in the event of an explosion.

The panel preferably comprises a sheet of glass material. More preferably, the panel is a laminated panel comprising one or more layers of glass material alternated with one or more layers of plastics material. It is an advantage that such a panel is not only transparent to allow viewing therethrough, but the multiple layers provide strength and the use of plastics layers between layers of glass aids in reducing the risk of fragments or shards of glass being propelled from the panel in the event of a blast (as the plastics material will hold the panel together to maintain its integrity).

Means may be provided for securing two or more of the plurality of frame members together. Preferably the door is rectangular or square in shape, and comprises four frame members joined together to provide a framework. This framework advantageously surrounds the entire perimeter of the panel, thus providing "cover" on all edges of the panel. The means of securing the frame members together may comprise tightening means for pulling two opposing frame members toward each other to clamp them against the panel. In an embodiment, the means for securing the frame members together comprises one or more rails spanning the distance between two opposing frame members. Preferably, the rails are housed within the other two frame members forming the rectangular frame. Such an arrangement advantageously strengthens the door to assist in maintaining its integrity in the event of a blast. It further minimises the risk of the door twisting under the force of an explosion. The provision of the tightening means advantageously enables the frame members to be securely clamped around the frame.

According to another aspect of the present invention, there is provided a method of fabricating a blast door. The method comprises: providing a substantially rectangular panel of a blast-resistant material; providing a frame comprising a first pair of frame members and a second pair of frame members; securing the first pair of frame members along a pair of opposing perimeter edges of the panel, the ends of each of the first pair of frame members not extending beyond the panel perimeter corners; securing the second pair of frame members along the other pair of perimeter edges of the panel, the second pair of frame members extending beyond the panel perimeter corners and overlapping the ends of the first frame members; connecting a tie-rail between each of the overlapping ends of one of the second frame members and the overlapping ends of the other of the second frame members, each tie rail extending along a cavity within a cross-section of a respective one of the first frame members; and tightening said tie rails so as to pull said opposing second frame members towards each other to clamp them against the panel.

According to another aspect of the present invention there is provided a method of fabricating a blast door. The method comprises the steps of providing a panel; providing a frame comprising a plurality of frame members, each having a cross-section that includes a cavity, around the perimeter of the panel, the panel perimeter being received within the frame to enclose a perimeter portion of the panel on either side thereof; and securing the panel within said frame by providing securing means located within the cavity of the frame.

Building the frame around the panel (compared with offering the panel to a pre-constructed frame as in known methods) enables each edge of the panel to be completely encased and supported within the frame. It is a further advantage that the method provides a simple and quick way of manufacturing blast door (without the need for additional clip-on frame sections or beading to hold the panel in place) to the required standards.

In embodiments of the fabrication methods, the frame member cross section is c-shaped, and the method comprises providing the panel perimeter within the c-shaped cavity. Advantageously, the frame supports the panel on both sides equally, and the frame is of a simple construction that is easy to manufacture. Conveniently, the frame is of a unitary construction, for example a single component of extruded metal.

In an embodiment, the method further comprises providing means within the frame for securing the panel within the frame. The step of securing the panel within the frame may comprise providing bonding material within the cavity of the frame, between the frame and the panel. The bonding material may be a fluid injected into the cavity that subsequently hardens, setting the panel in place. The frame cavity defines an opening into the frame the method may further provide for sealing the gap between the cavity opening and the panel. Preferably, this sealing utilises rubber seals. Additionally, the panel may be supported by one or more supports mounted within the frame member cavity to receive the perimeter of the panel, these supports being shaped to correspond to the profile of the perimeter of the panel. This facilitates location and securing of the panel within the frame both during and after its construction.

In an embodiment, the step of providing a frame around the perimeter to encase and support the panel of both sides provides a "cover" of about 35 mm. The unitary single extruded metal section frame members conveniently provide this cover. In comparison to the known method discussed in the introductory text above, which can only provide a cover in the region of 7 mm (due to the size of clip-on components/beading used) Advantageously, the present method provides superior cover. Embodiments of the present invention thus provide a method for manufacturing blast doors of superior integrity than has been possible before.

The step of providing a panel may comprise providing a panel of glass material. Preferably, the step of providing a panel comprises providing a laminated panel comprising one or more layers of glass material alternated with one or more layers of plastics material.

In an embodiment, the method further comprises securing two or more of said plurality of frame members together. Preferably, the door is rectangular in shape, and comprises four members joined together to provide a framework providing "cover" to all edges of the panel. The step of securing two or more of the plurality of frame members together may comprise pulling two opposing frame members towards each other to clamp them'against said panel. The method may further comprise providing one or more rails spanning the distance between two opposing sides of the rectangular framework. Preferably the rails are housed within the other two frame members forming the rectangular frame.

According to another aspect of the present invention there is provided a blast door installation comprising one or more blast doors as defined above. One or more panels are moveably mounted with respect to a doorway and the doors are moveable between an open position and a closed position with respect to the doorway. It is an advantage that such door assemblies are of a strong construction and capable of withstanding bomb blasts to the relevant standards, whilst comprising minimal component parts.

In an embodiment, the installation comprises one or more guide means for guiding the movement of the one or more doors with respect to the doorway. Preferably, the one or more guide means are provided at the top and/or bottom of the doorway. The guide means may comprise roller means moveable with respect to a track, the roller means and track each being provided on either the doorway or on one or more of the doors. This provides a convenient way for mounting and guiding the movement of the doors to ensure they move along the desired path.

In an embodiment, the installation further comprises a buffer for cushioning movement of one or more parts of the door installation caused by a blast. Such provision advantageously offers protection to and limits movement of the door installation.

In an embodiment, the installation further comprises reinforced members at the top and/or bottom of the installation for maintaining engagement between the doors and the guide means in the event of a blast. This advantageously adds strength to the installation to aid in withstanding a blast. Preferably the reinforced members comprise one or more metal plates affixed to the installation to strengthen said installation and resist movement due to energy from a blast.

According to another aspect blast door installation comprising at least one blast door having a panel of a blast-resistant material secured in a frame around the perimeter of the panel. The frame comprises a plurality of frame members each having a cross section that includes a cavity in which said panel perimeter is received such that the frame encloses a perimeter portion of the panel on either side thereof. The door is moveable between an open position and a closed position with respect to a doorway, and further comprises one or more guide means at the top and/or bottom of the doorway, a buffer for cushioning movement of one or more parts of the door installation caused by a blast, and reinforced members at the top and/or bottom of the installation for maintaining engagement between the doors and the guide means in the event of a blast.

In embodiments of the blast door installations, the doors are slidably mounted with respect to the doorway.

In an embodiment, the installation comprises one or more guide means for guiding the movement of the one or more doors with respect to the doorway. Preferably, the one or more guide means are provided at the top and/or bottom of the doorway. The guide means may comprise roller means moveable with respect to a track, the roller means and track each being provided on either the doorway or on one or more of the doors. This provides a convenient way for mounting and guiding the movement of the doors to ensure they move along the desired path.

In an embodiment, the installation comprises one or more sensor means operable for sensing an entity approaching the installation and causing the one or more doors to open. It is an advantage that the doors can thus be caused to open automatically. They can further be configured to close at a predetermined time thereafter. The sensor means may alternatively be configured to detect authorised personnel only (e.g. by way of a swipe card, remote sensing device etc.) in order to restrict access to an area if required. Again, the doors may be configured to open automatically on detection of proper authorisation for access, and to close after a predetermined time, e.g. shortly after a person has passed through.

According to another aspect of the invention there is provided a blast door comprising a panel. A frame provided around the perimeter of the panel, the frame comprising a plurality of frame members wherein each frame member has a cross section that includes a cavity in which the panel perimeter is received such that the frame encloses a perimeter portion of the panel on either side thereof. Securing means secure the panel within the frame, the securing means being provided within the cavity of the frame. One or more supports are mounted within the cavity, the supports being shaped to correspond to the profile of the perimeter of the panel.

Figure 2B:
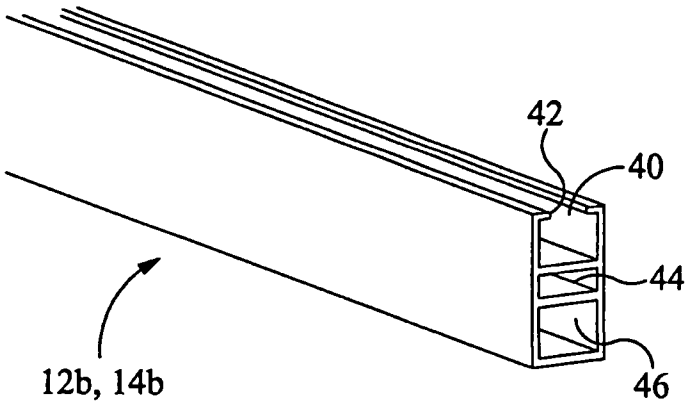
Figure 2A:
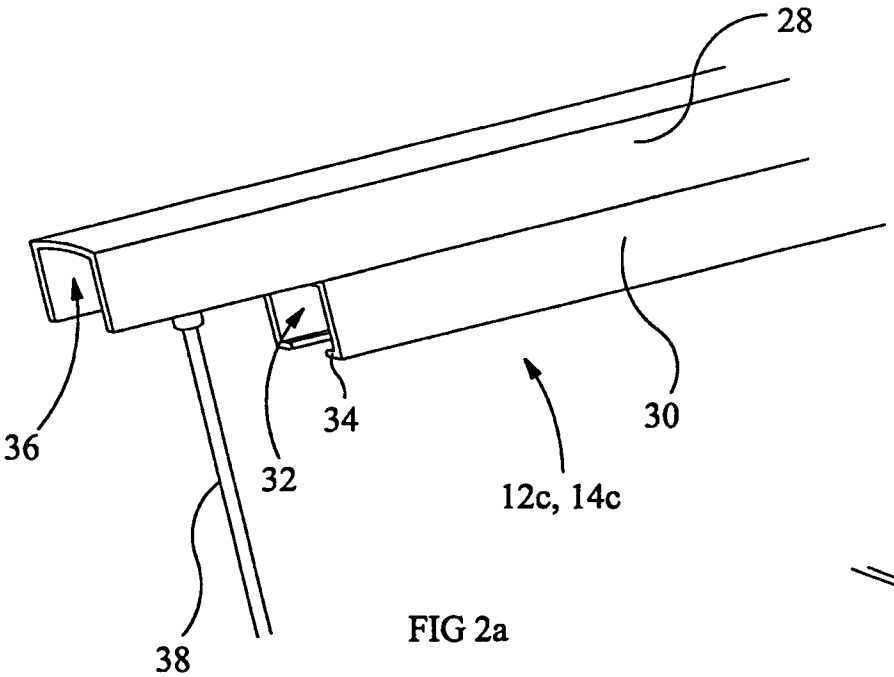
Figure 3:
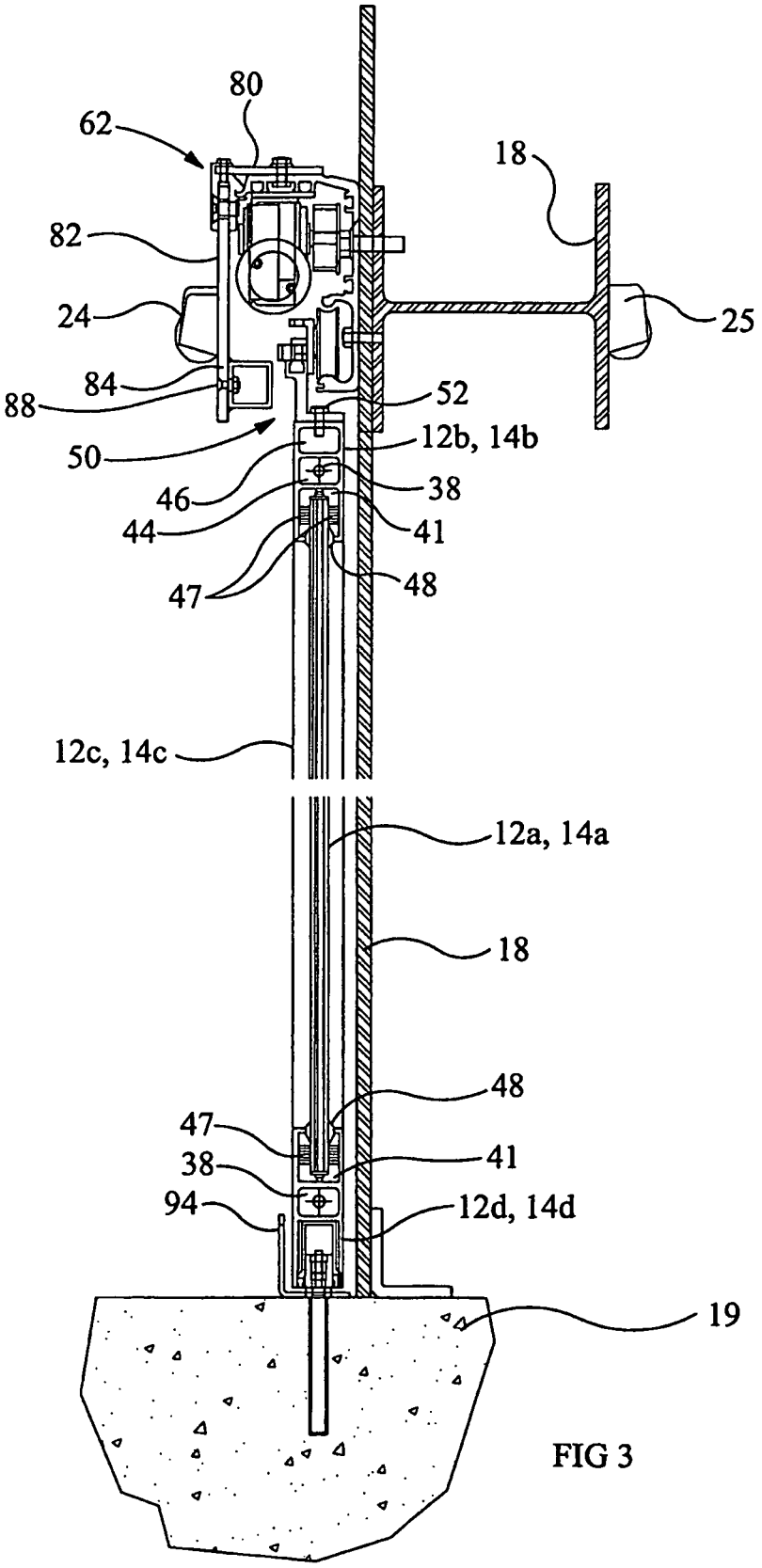
Figure 4A:
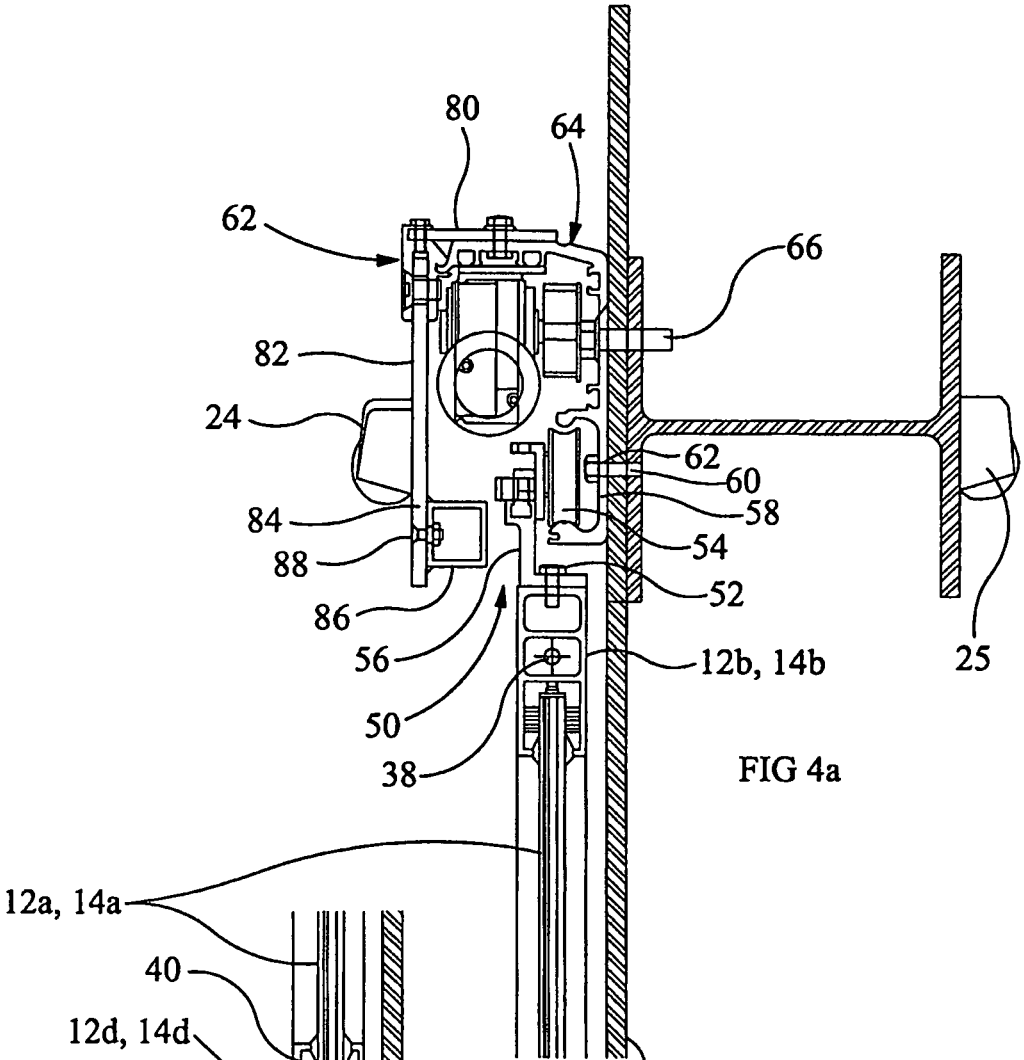
Figure 4B:
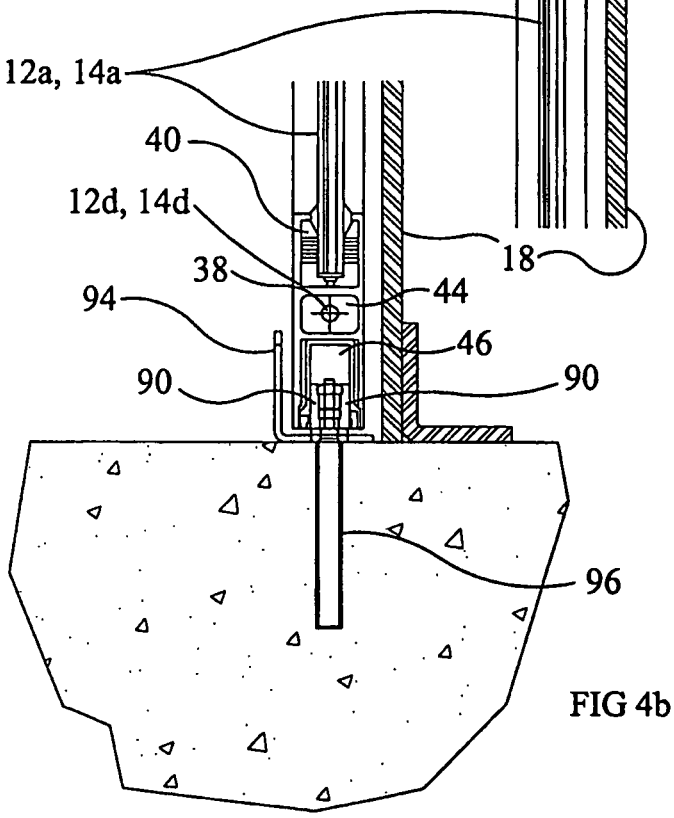
Figures 5A, 5B, 5C, 6:
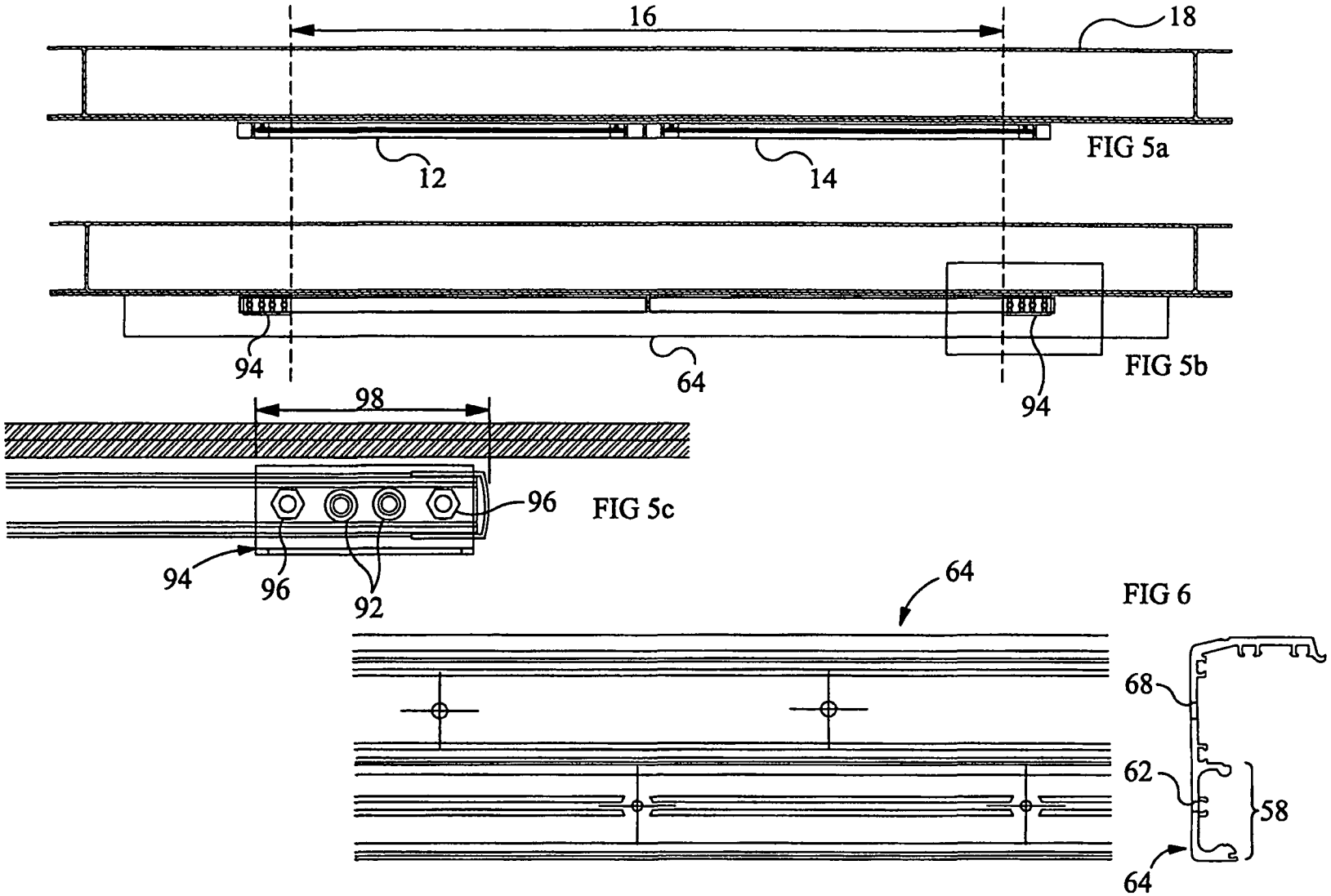

Embodiments of the invention will now be described by way of example with reference to the following drawings, wherein:

FIG. 1 is a schematic view of a blast door installation of an embodiment of the present invention;

FIGS. 2*a* and 2*b* are views of door frame components of FIG. 1;

FIG. 3 is a detailed cross sectional view of the blast door installation of FIG. 1;

FIG. 4*a* is an enlarged view of the upper part of the blast door installation of FIG. 3;

FIG. 4*b* is an enlarged view of the lower part of the blast door installation of FIG. 3;

FIGS. 5*a* and 5*b* are views of the upper guide of the blast door installation of FIG. 3;

FIG. 5*c* is a view of the floor guide of the blast door installation of FIG. 3; and FIG. 6 shows plan and cross sectional views of the header unit of the blast door installation of FIG. 3.

Referring to FIG. 1, a blast door installation 10 comprises two doors 12, 14 mounted with respect to a doorway 16. The doors 12, 14 comprise central panels 12*a*, 14*a* and a surrounding frame. The frame comprises substantially horizontal upper frame members 12*b*, 14*b* and lower frame members 12*d*, 14*d*, and substantially vertical side members 12*c*, 14*c*. The doorway 16 is defined by a surrounding wall, construction or supports on either side 18 and above 20 the doors 12, 14. The door installation 16 is provided above the ground or floor 19.

The doors 12, 14 are slidably mounted with respect to the doorway 16 such that the left hand door 14 (as shown in FIG. 1) slides in the direction of arrow A to open, and the right hand door (as shown in FIG. 1) slides in the opposite direction shown by arrow B to open. The doors 12, 14 are configured to return to their closed position by movement in the opposite direction, towards each other. The mechanism that enables doors 12, 14 to slide open and closed is housed within guide unit 22, and will be discussed in greater detail below with reference to FIGS. 3, 4*a*, 5*a*, 5*b* and 6. A proximity sensor 24 is provided for detecting approaching movement (e.g. of a person or a vehicle), in response to which the doors 12, 14 are caused to open. A second proximity sensor 25 (shown in FIG. 3) is provided on the other side of the doors 12, 14, to detect movement from that direction. Additional sensors 26 are fitted to each side of the doorway. These sensors 26 are operable for detecting an entity in the vicinity of the door as it opens and/or closes. Means are provided for slowing the movement of the door in the opening/closing direction in the event of an entity being detected.

The central panel 12*a*, 14*a* of each door comprises glass material. In preferred embodiments, the panels 12*a*, 14*a* comprise laminated glass. This may be a sandwich of a sheet of plastics poly vinyl butyral (PVB) between two sheets of glass. The PVB adheres to the glass, forming a chemical and a mechanical bond. When laminated with annealed glass, the layer maintains the geometric integrity of the pane in case of breakage. In an exemplary embodiment, a sandwich comprises three layers of 4 mm thick annealed glass with 1.5 mm thick laminate layers therebetween, providing a total thickness of 15 mm.

Referring to FIG. 2*a*, a portion of a side door frame member 12*c*, 14*c* is shown. The frame member 12*c*, 14*c* comprises a length of outer frame section 28 and a shorter, inner frame section 30 attached thereto along its length. The inner frame section 30 is of a c-shaped cross section defining a longitudinal cavity 32. The inner frame section 30 also has inwardly-directed longitudinal flange portions 34. The outer frame section 28 is of a u- or c-shaped cross section defining a cavity 36. A rail or tie-rod 38 is attached to the interior of the cavity 36 with a reinforcing plate and a nut (not shown). Each of the two side door frame members 12*c*, 14*c* is substantially identical, and two rods 38, provided towards the ends thereof, span the distance between them. The rods 38 are provided with tightening means 39 at or towards one or both ends thereof, for tightening the system to adjust the distance between the two side door frame members 12*c*, 14*c* e.g. by pulling them toward each other.

Referring to FIG. 2*b*, a portion of an upper door frame member 12*b*, 14*b* is shown. Each frame member 12*b*, 14*b* comprises a cavity 40 within a c-shape cross section, with longitudinal flanges 42 similar to those described above for the side frame members 12*c*, 14*c*. The frame member 12*b*, 14*b* comprises two further cavities 44, 46 aligned along the length of the frame member 12*b*, 14*b*. The rail 38 of the side door frame members is received within the middle cavity 44 when the door is fully assembled. Housing the rails 38 within the framework adds strength to the doors 12, 14 and helps minimise the chance of twisting and/or deformation of the door in the event of a blast.

The lower frame members 12*d*, 14*d* are similar in structure to the upper frame members 12*b*, 14*b* but the outermost cavity 46 is open instead of closed. However, in the embodiment shown in FIG. 1 (and in FIG. 3), the height of the cavity 46 of the lower frame member is greater than that of the upper frame member, for housing additional components of the door installation 10 as will be discussed in more detail below. The upper and lower frame members 12*b*, 14*b*, 12*d*, 14*d* are shown and described as having three cavities spaced along their height, but it will be appreciated that fewer or more cavities may provided whilst still achieving the desired functionality.

One or more support inserts 41 (as shown in FIG. 3) may also be provided within the cavities 32, 40 of each frame member 12*b*, 14*b*, 12*c*, 14*b*, 12*d*, 14*d*, in which the edges of the panel 12*a*, 14*a* are received. The supports may be shaped to have recesses that correspond to the profile of the edges of the panel 12*a*, 14*a*. The support inserts are typically of a rigid plastics material, secured to the frame members by screws (not shown) and aid in locating the panel 12*a*, 14*a* in the correct position within the frame during manufacture, adding stability to the structure thereafter.

In order to assemble a door 12, 14, two side door frame sections 12*c*, 14*c*, an upper door frame section 12*b*, 14*b* and a lower door frame section 12*d*, 14*d* are required. Support inserts 41 are fixed in position within the frame member cavities Bonding material 47 (shown in FIG. 3) is provided within the cavities 32, 40 of the frame sections 12*b*, 14*b*, 12*c*, 14*c*, 12*d*, 14*d*. This bonding material 47 may be a fluid (e.g. a structural adhesive) or a mouldable silicone-based structural glazing sealant material injected into the cavities, which subsequently sets to secure the panel in position. The frame 12*b*, 14*b*, 12*c*, 14*c*, 12*d*, 14*d* is then assembled around the central panel 12*a*, 14*a*, the perimeter of the panel 12*a*, 14*a* being inserted into the cavities 32, 40 of the frame sections 12*b*, 14*b*, 12*c*, 14*c*, 12*d*, 14*d* to make contact with the bonding material 47. The rod 38 is passed through the central cavity 44 of the upper and lower door frame section 12*b*, 14*b*, 12*d*, 14*d*. To further secure the central panes 12*a*, 14*a* in position, seals 48 (shown in FIG. 3) are provided between the flanges 34, 42 of the cavities 32, 40 and the central panes 12*a*, 14*a*. The seals 48 may be in the form of a rubber strips pressed into the gap between the panel 12*a*, 14*a* and the flanges 34, 42. The strips 48 may have a recess to engage the longitudinal flanges 34, 42. The frame sections 12*b*, 14*b*, 12*c*, 14*c*, 12*d*, 14*d* are then secured to each other, by tightening the tie-rods 38 to clamp the frame members 12*b*, 14*b*, 12*c*, 14*c*, 12*d*, 14*d* around the panel 12*a*, 14*a*.

Referring to FIG. 3, a cross sectional view through a door 12, 14 is shown relative to a wall/support 18 and the ground 19. The right hand side of the installation 10 is the "threat side"—i.e. the side on which a blast could occur, and the left hand side of the installation 10 is the "protected side" which the blast door installation 10 serves to protect.

The upper frame section 12*b*, 14*b* is connected, via a bolt 52, through the face of the outermost cavity 46 to an upper movement guide means 50 (which is enlarged in FIG. 4*a*). The upper guide means 50 comprises one or more rollers or wheels 54 that are freely rotatable with respect to, and mounted on, a support 56. The rollers 54 are received within a track 58 fixed to the wall 18 by means of a bolt 60. The track 58 extends beyond the width of the doorway 16 on either side, allowing the wheels 54 to run along it such that the doors 12, 14 are supported in their open position.

The track 58 is part of a larger header unit 62 formed in part from a length of extruded metal section 64, shown in more detail in plan and cross sectional views in FIG. 6. The length of extruded metal section 64 extends upwardly from the track 58 and substantially horizontally outwardly. A further bolt 66 aids in securing the unit 64 to the wall 18 through aperture 68. A drive installation 70 including a motor is provided within the header unit 62, and coupled to the roller/track installation 54, 58 to open and close the doors 12, 14 when required.

A horizontally extending reinforcing plate 80 is bolted to the length of extruded metal section 64. The reinforcing plate 80 is conveniently made of spring steel. A deformable plate 82 (preferably constructed of aluminium) is clamped to the reinforcing plate 80 to depend vertically therefrom. The sensor 24 is mounted to the deformable plate 82, facing outwardly on the protected side. The second sensor 25 is mounted on the wall 18 on the opposite side of the installation facing outwardly toward the threat side. In the embodiment of FIGS. 3 and 4*a*, the second sensor 25 is mounted on a beam (e.g. of steel) fixed to the wall 18.

A buffer 84 is provided to absorb energy in the event of a blast in order to protect the components of the door installation. In the embodiment shown, the buffer 84 is connected to the deformable plate 82, located on the opposite side of the plate 82 to the sensor 24, facing inwardly toward the door 12, 14 and guide means 50. The buffer 84 comprises a length of aluminium box section 86 bolted to the plate 82 via bolt 88. In the event of a blast or explosion occurring on the threat side of the door installation, the buffer 82 cushions any part of the guide means 50 and/or the upper part of the door installation forced toward it due to the energy of the blast.

It will be appreciated that the arrangement of the header unit 64 and the components situated therein, especially the buffer 84, could be altered without departing from the intended purpose and results achieved. The sensors 24, 15 could be mounted separately from the door installation 10, on the wall 18 for example, additional buffers could be provided both on the protected and threat sides of the installation etc.

Referring to FIGS. 3 and 4*b*, the cavity 46 of lower frame section 12*d*, 14*d* houses a lower movement guide means 90. The guide means 90 comprises a roller or wheel 92 that is mounted and sits within the cavity 46, and a base guide 94, to assist in maintaining the correct path of movement of the doors 12, 14. The base guide shown in L-shaped with the lower limb attached to the ground and the upward limb located on the protected side of the door installation 10. The base guide 94 is preferably reinforced, and constructed from a steel sheet, and more preferably from a 4 mm thick grade 316 stainless steel sheet. The base guide 94 is fixed to the ground 19 with threaded rods 96. The rods 96 are bonded into the ground with a bonding agent, e.g. a two-part bonding mixture such as Nitromorter™.

As can be seen from FIGS. 3, 4*a* and 4*b*, the upper and lower edges of the central pane 12*a*, 14*a* are received completely within the cavities of the upper 12*b*, 14*b* and lower 12*d*, 14*d* door frame sections, this "coverage" being denoted 'X'. Fabrication of the door panels 12, 14 in the manner previously described provides a coverage X in the region of 35 mm.

FIGS. 5*a* and 5*b* respectively show top and underneath views of the door installation 10, and how the doors 12, 14 are located with respect to the doorway opening 16. The header unit 64 and the base guide 94 can also be seen in FIG. 5*b*. FIG. 5*c* is an enlarged view of the floor guide 94 in FIG. 5*b*, showing the rollers/wheels 92 and the fixing rods 96. FIG. 5*c* also shows the location of the guide 94 with respect to the opening 16, and the overlap 98 of the door to the doorway 16 when the doors 12, 14 are in the closed position.

In use, one or both of the sensors 24, 25 is operable for sensing movement of an entity (e.g. person or vehicle) approaching the doors 12, 14. The sensors are operable to cause the doors 12, 14 to part and thus open. The upper and lower guide means 50, 90 ensure that the doors 12, 14 move along the correct path whilst opening and closing. A preset time after opening, the doors automatically close (provided no further approaching entities are detected).

In the event of an explosion e.g. a bomb blast, the door installation 10 is configured to withstand the impact. Tests have shown that the installation 10 can withstand a bomb blast equivalent to 100 kg of TNT (trinitrotoluene) over a distance of 25 meters. Embodiments of the invention enable the installation 10 to withstand such a blast for the following reasons.

Firstly, the doors 12, 14 are prevented from jumping off the track through reinforcing the header unit 64 with the plate 80. The provision of the buffer 84 further acts to stabilise the track 58/roller 54 system in the event of a blast.

In addition, the floor guide 94 is reinforced to assist in preventing the doors 12, 14 jumping off the rollers 90, 92 at the base of the installation 10. The floor guide 94 is L-shaped, which assists in containing the movement of the base of the doors 12, 14 in the event of a blast on the threat side of the doors 12, 14.

The frame 12*b*, 14*b*, 12*c*, 14*c*, 12*d*, 14*d* itself is strong, each frame member being formed of a unitary cross section. The assembled frame is resistant to twisting and deformation, which assists in maintaining the integrity of the door installation 10 in the event of a blast.

TABLE 1

| Test Standard | Peak Reflected Pressure | Positive reflective Impulse |
|---|---|---|
| GSA C | 27.6 kPa | 193 kPams |
| ISO EXV 45 | 30 kPa | 180 kPams |
| GSA C/ISO EXV 45 Combined | 30 kPa | 193 kPams |
| ISO EXV 25 | 80 kPa | 380 kPams |

Two tests were performed. In Test 1, the door system was tested against GSA C/ISO 45. The overall result was as follows:

GSA (C)—Pass—Hazard Category: Very low Hazard

ISO EXV 45—Pass—Hazard Category: Very low Hazard

In Test 2, the door system was tested against ISO EXV 25, with the following result:

ISPO EXV 25—Pass—Hazard Category: Low Hazard.

Table 2 below explains the meaning of the results of these tests.

TABLE 2

| UK Terminology | US GSA Terminology (Performance Level) | Protection Level | Hazard Level | Description of window/Glazing Response |
|---|---|---|---|---|
| Break safe | 1 | Safe | None | Glazing does not break, no visible damage to glazing or frame |
| | 2 | Very High | None | Glazing cracks but is retained by the frame, dusting of very small fragments near sill or on floor acceptable |
| | 3a | High | Very Low | Glazing Crack. Fragments enter space and land on floor no further than 3.3 ft from the window |
| Low Hazard | 3b | High | Low | Glazing Crack. Fragments enter space and land on floor no further than 10 ft from the window |
| | 4 | Medium | Medium | Glazing Crack. Fragments enter space and land on floor and impact a vertical witness panel at a distance of no more than 10 ft from the window at a height no greater than 2 ft above the floor |
| High Hazard | 5 | Low | High | Glazing Crack. Fragments enter space and land on floor and impact a vertical witness panel at a distance of no more than 10 ft from the window at a height greater than 2 ft above the floor |

The 35 mm coverage to which the central panel 12*a*, 14*a* is embedded within the door frame 12*b*, 14*b*, 12*c*, 14*c*, 12*d*, 14*d* ensures that the panels 12*a*, 14*a* remain in position within the frame in the event of a blast. The bonding material 47 and or the boding material 48 further assist in keeping the panels 12*a*, 14*a* correctly positioned. This construction does not have additional clip-on frame sections or beading to hold the central panels in position, so there is no risk of any beading being forced out by a blast.

The use of laminated glass panels 12*a*, 14*a* (comprising alternating layers of glass and plastics laminate) provides integrity of the pane in case of breakage. That is to say, should the blast be sufficiently energetic to break the glass, the composition of the panels 12*a*, 14*a* is such as to prevent panel shards or fragments being propelled therefrom.

The installation 10 as described above thus provides a secure means of access whilst offering protection on the protected side of the door. The door installation of he present invention has been tested according to various Test Standards. Table 1 summarises the results of these tests.

It will be appreciated that although the embodiments described relate to moveable doors, the principles described are equally applicable to fixed panels, as well as to windows (fixed or moveable). The method of manufacturing the embodiments of the invention could be applied to the fabrication of such fixed panels or windows.

The invention claimed is:

1. A method of fabricating a blast door, the method comprising the steps of:

providing a substantially; rectangular panel of a blast-resistant material;

providing a frame comprising a first pair of frame members and a second pair of frame members, each frame member being formed of a single extruded element, wherein each of the first pair of frame members includes three cavities extending along the full length of the frame members, one of the cavities being a c-shaped cavity, and wherein each of the second pair of frame members has a cross-section that includes a c-shaped cavity;

inserting a pair of opposing perimeter edges of the panel into an opening of each c-shaped cavity of said first frame members such that the first frame members enclose a perimeter potion of the panel on either side thereof;

securing said first pair of frame members along the pair of opposing perimeter edges of said panel, the ends of each of said first pair of frame members not extending beyond the panel perimeter corners;

inserting the other pair of perimeter edges of the panel into an opening of each c-shaped cavity of said second frame members to enclose a perimeter portion of the panel on either side thereof;

securing said second pair of frame members along the other pair of perimeter edges of the panel, said second pair of frame members extending beyond the panel perimeter corners and overlapping the ends of the first frame members;

connecting a tie-rail between each of the overlapping ends of one of said second frame members and the overlapping ends of the other of said second frame members, each tie rail extending along one of the three cavities within the cross-section of a respective one of said first frame members;

tightening said tie rails so as to pull said opposing second frame members towards each other; and contacting said panel with a base of the cavity of each of said second pair of frame members as said tie-rails are tightened to clamp said second pair of frame members against said panel thereby applying clamping force which secures the panel in the frame.

2. The method of claim 1, wherein the steps of securing said frame members comprises providing bonding material between said frame members and said panel within the c-shaped cavities of said frame members.

3. The method of claim 2, further comprising sealing between the panel and the c-shaped cavities.

4. The method of claim 1, further comprising supporting the panel within said frame members with supporting means shaped to correspond to the profile of said perimeter of said panel.

5. A blast door comprising:

a substantially rectangular panel of a blast-resistant material;

a frame provided around the perimeter of the panel, the frame comprising a first pair of frame members secured along a pair of opposing perimeter edges of the panel, the ends of each of said first pair of frame members not extending beyond the panel perimeter corners, and a second pair of frame members secured along the other pair of perimeter edges of the panel, said second pair of frame members extending beyond the panel perimeter corners and overlapping the ends of the first frame members, wherein each frame member is formed of a single extruded element and wherein each of the first pair of frame members has a cross section that includes three cavities extending along the full length of the first frame members, one of the cavities being a c-shaped cavity with an opening into which the panel perimeter is received such that the first frame members enclose a perimeter portion of the panel on either side thereof, and wherein each of the second pair of frame members has a cross section that includes a c-shaped cavity with an opening into which the panel perimeter is received such that the second frame members enclose a perimeter portion of the panel on either side thereof; and a tie-rail extending between each of the overlapping ends of one of said second frame members and each of the overlapping ends of the other of said second frame members, each tie rail extending along one of the three cavities of a respective one of said first frame members, wherein said tie-rails are tightened so that said tie-rails pull two opposing frame members toward each other, and wherein a base of the c-shaped cavity of each of said second pair of frame members contacts said panel as said tie-rails are tightened to clamp said second pair of frame members against said panel thereby applying clamping force which secures the panel in the frame.

6. The blast door of claim 5, wherein the frame encloses the panel perimeter to provide a cover of at least 35 mm.

7. The blast door of claim 5, comprising securing means for securing the panel within the frame, the securing means being provided within the c-shaped cavity of the frame.

8. The blast door of claim 7, wherein said securing means comprises bonding material provided within the cavity of the frame, between the frame and the panel.

9. The door of claim 5, wherein sealing means are provided between the cavity opening and the panel.

10. The blast door of claim 9, wherein said sealing means comprise rubber seals.

11. The blast door of claim 5, wherein each of the plurality of frame members is a single component of extruded metal.

12. The blast door of claim 5, further comprising one or more supports mounted within said cavity, said supports being shaped to correspond to the profile of said perimeter of said panel.

13. The blast door of claim 5 wherein said panel comprises a panel of glass material.

14. The blast door of claim 13 wherein said panel is a laminated panel comprising one or more layers of glass material alternated with one or more layers of plastics material.

15. The blast door of claim 6, comprising securing means for securing the panel within the frame, the securing means being provided within the c-shaped cavity of the frame.

16. The blast door of claim 8, wherein sealing means are provided between the cavity opening and the panel.

17. The blast door of claim 10, wherein each of the plurality of frame members is a single component of extruded metal.

18. The blast door of claim 17, further comprising one or more supports mounted within said cavity, said supports being shaped to correspond to the profile of said perimeter of said panel.

19. The blast door of claim 18 wherein said panel comprises a panel of glass material.

* * * * *